US012004613B2

(12) United States Patent
Ostanin

(10) Patent No.: US 12,004,613 B2
(45) Date of Patent: Jun. 11, 2024

(54) ITEM OF JEWELRY

(71) Applicant: Aleksey Ostanin, Krasnogorsk (RU)

(72) Inventor: Aleksey Ostanin, Krasnogorsk (RU)

( * ) Notice: Subject to any disclaimer, the term of this patent is extended or adjusted under 35 U.S.C. 154(b) by 0 days.

(21) Appl. No.: 18/500,869

(22) Filed: Nov. 2, 2023

(65) Prior Publication Data

US 2024/0065391 A1 Feb. 29, 2024

Related U.S. Application Data

(63) Continuation of application No. 18/021,780, filed as application No. PCT/IB2021/053295 on Apr. 21, 2021.

(30) Foreign Application Priority Data

Jun. 19, 2020 (RU) ..... RU2020120498

(51) Int. Cl.
*A44C 9/00* (2006.01)
*A44C 17/02* (2006.01)

(52) U.S. Cl.
CPC ..... *A44C 9/003* (2013.01); *A44C 17/02* (2013.01)

(58) Field of Classification Search
CPC ..... A44C 17/02; A44C 9/003; A44C 17/0208; A44C 17/0216; A44C 9/0053; A44C 9/0007; A44C 9/0015; A44C 9/00
USPC ..... 63/15.1, 15.2, 15.3, 15.4
See application file for complete search history.

(56) References Cited

U.S. PATENT DOCUMENTS 1,245,201 A * 11/1917 Depollier ..... A44C 9/0023 63/15.4
1,529,026 A * 3/1925 Kraus ..... A44C 9/0023 63/15.4
1,800,227 A * 4/1931 Novack ..... A44C 9/0023 63/15
3,933,011 A * 1/1976 DiGilio ..... A44C 17/0208 63/29.1
5,077,989 A * 1/1992 Dillabaugh ..... A44C 17/0216 63/29.1

(Continued)

FOREIGN PATENT DOCUMENTS

FR 2650489 A1 * 8/1989
FR 2781345 A1 * 1/2000 ..... A44C 9/0015

(Continued)

OTHER PUBLICATIONS

Russian Patent Office, International Search Report for International Application No. PCT/IB2021/053295, dated Sep. 24, 2021.

*Primary Examiner* — Jack W Lavinder

(57) ABSTRACT

The disclosure refers to jewelry or rings worn on fingers with embedded decorative jewels. The technical problem to be solved is to increase the reliability of fixing the decorative jewel by eliminating its mobility and expanding the jewelry's artistic and aesthetic significance. The piece of jewelry contains a decorative Jewel located in a setting and an annular jewelry part with a boss. On the surface of the boss, there is at least one longitudinal groove and an annular part that intersect with each other. The setting is made hollow with a cylindrical inner surface and may be installed to the boss along the inner surface. On the inner surface there is at least one protrusion that may be engaged in the groove of the jewelry part.

2 Claims, 7 Drawing Sheets

(56) References Cited

U.S. PATENT DOCUMENTS

| | | | | | |
|---|---|---|---|---|---|
| 5,228,317 | A * | 7/1993 | Hendricks | A44C 17/0208 | 63/29.1 |
| 5,456,095 | A * | 10/1995 | Tawil | A44C 17/0216 | 63/15 |
| 8,316,666 | B2 * | 11/2012 | Patterson | A44C 17/0216 | 63/15.4 |
| 9,113,681 | B2 * | 8/2015 | Machini | A44C 17/0208 | |
| 9,439,484 | B2 | 9/2016 | Nevatia | | |
| 2015/0320154 | A1 | 11/2015 | Nevatia | | |

FOREIGN PATENT DOCUMENTS

| | | | | |
|---|---|---|---|---|
| FR | 2865617 | A1 * | 8/2005 | A44C 9/0015 |
| RU | 26895 | U | 1/2003 | |
| RU | 127295 | U | 4/2013 | |

* cited by examiner

Kind A

ITEM OF JEWELRY

CROSS-REFERENCE TO RELATED APPLICATIONS

The present application is a continuation of the application Ser. No. 18/021,780, entitled "ITEM OF JEWELRY," currently pending, which is a national state entry of the international application No. PCT/IB2021/053295, and claims priority to Russian patent application No. 2020120498, all of which are incorporated herein by reference.

BACKGROUND OF THE INVENTION

The utility model refers to jewelry, in particular to rings worn on fingers, with embedded decorative jewels.

A ring with a movable decorative jewel is known, including a body with an opening and a decorative jewel installed in it, containing a stand and a convex base, while the decorative Jewel is placed in the hole of the ring body in such a way that when the ring is put on the finger, the convex base of the said decorative Jewel, rests on the surface of the finger (see PI RF No. 2374964, A44C 9/00). In this case, the length of the post of the decorative Jewel is chosen more than the length of the hole in the ring body, and the diameter of the post is less than the diameter of the specified hole (see PI RF No. 2374964, A44C 9/00).

The disadvantage of the known design is its complexity and significant manufacturing costs. The decorative jewel is pre-installed in the conical setting of the rack, which is subsequently connected to the convex base through a blind hole. The connection is made within the inner cavity of the ring, which is known to be problematic. For the metals or jewels mentioned in this patent, the reference is made, for example, by welding or soldering. In addition, such labor leads to an increase in manufacturing costs.

Branded jewelry, which is a ringed jewel of a given external shape, with a central hole, on the outer surface of which a decorative jewel is fixed (see RF PM No. 26181, A44C 9/00). The ring-shaped jewel is assembled and includes a minimum of two flat plates, with a central hole located in each piece, located at a pre-determined distance from each other. The plates are interconnected by screws passing through the prefabricated holes in the plates located between the plates. For mounting the decorative jewel, sockets are made in the plates. Technical holes in the plates can be used to install decorative jewel inserts. The outer shape of the plates can be fabricated circular, trilateral, or four-sided with rounded corners, ovals or elliptical, with a flat cut of one of the surfaces for fixing decorative jewels.

The disadvantage of branded jewelry is the complexity of the design, requiring additional work when replacing the decorative jewel with a professional jeweler because unscrewing the screws involves the use of special tools. When removed, the entire piece of jewelry fragments into the jewels that make up the piece.

The impossibility of independent replacement of the decorative jewel directly by the user limits the possibilities of the artistic and aesthetic content of the jewelry.

The closest technical solution is a piece of jewelry containing a given shape of an annular jewel with a central hole, made prefabricated and including at least two main plates located at a distance from each other, fasteners passing through the technological gaps in the main plates, and the decorative jewel is situated in the nest (No. 127295 dated Nov. 8, 2012, A44C 9/00). In this case, the main plates are rigidly connected by a fabricated notch, in which a socket for the decorative jewel is made. Between the main plates of the annular jewel, at least one additional plate with a central hole and the prospect of contact with the decorative jewel is installed. The other plate is made with a prefabricated hole and is installed with the option of rotation around the axis of the fastener. To ensure the constant state of the jewel in the inoperative position, the plates are equipped with a relative position lock, parts of which are located on the main and additional plates.

The disadvantage of the technical solution is the excessive mobility of the decorative jewel in the setting and the need for additional costs to eliminate it. This is because the height of the decorative jewel differs from the height of the seat in the boss. In this situation, it is necessary to adjust all decorative jewels to the same height with an increased requirement for accuracy.

SUMMARY OF THE INVENTION

The technical problem to be resolved by the utility model is to increase the reliability of fixing a decorative jewel by eliminating its mobility and expanding the artistic and aesthetic significance of the jewelry.

The technical problem is solved by the fact that in a known piece of jewelry containing a decorative jewel located in a setting of a given shape, an annular jewel prefabricated by a central hole and made in the form of two main plates, situated at a distance from each other and connected by a cylindrical boss, a fastener, an additional plate with a central hole and pivotally fixed on the main plate, an extra plate position lock. On the surface of the boss, there is at least one longitudinal groove and an annular connected to it; the setting is made hollow with a cylindrical inner surface, with the possibility of installation on it on the boss, and on the inner surface there is at least one protrusion with the possibility of its placement in the grooves of the boss.

In addition, a recess is made on the end surface of the setting with the possibility of a part of the additional plate entering it.

BRIEF DESCRIPTION OF DRAWINGS

The invention, together with the above and other objects and advantages, will be best understood from the following detailed description of the preferred embodiment of the invention shown in the accompanying drawings, wherein.

DETAILED DESCRIPTION OF THE INVENTION

Figure 1:
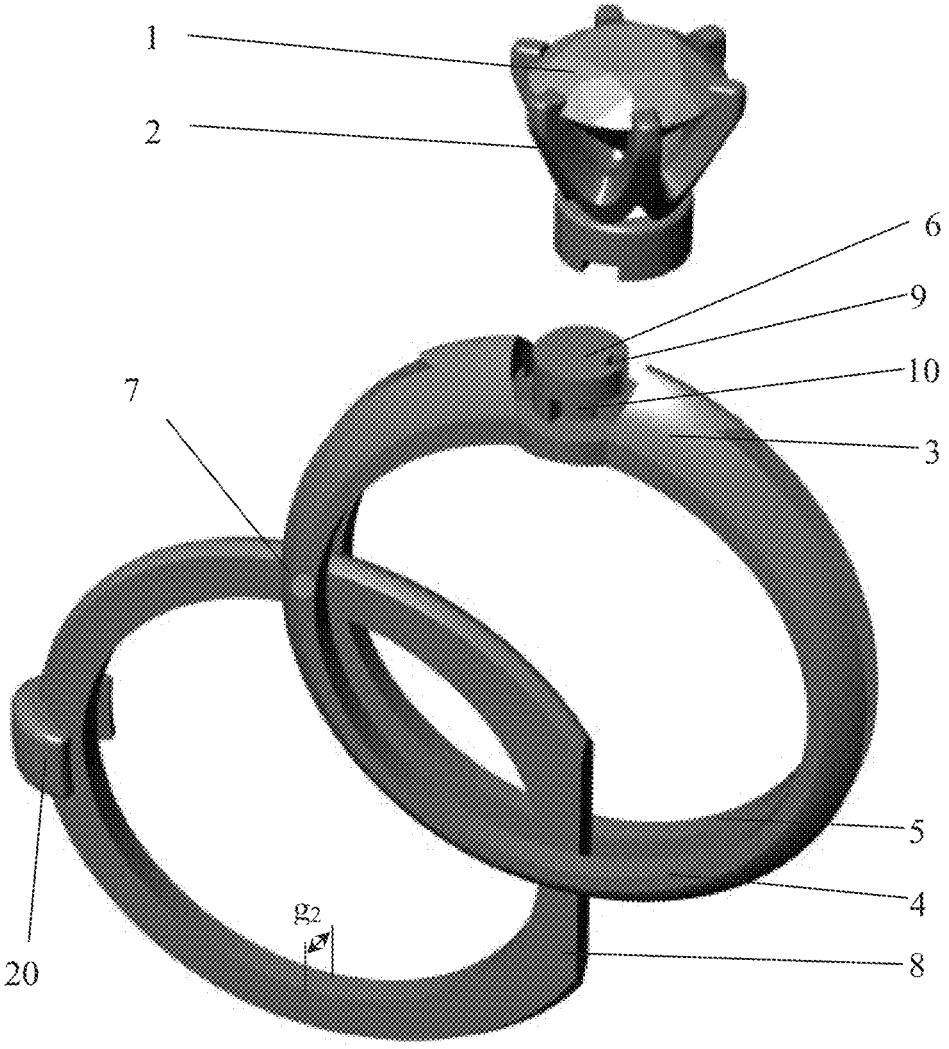
FIG. 1 is a perspective view of a jewelry before a setting is installed.
Figure 2:
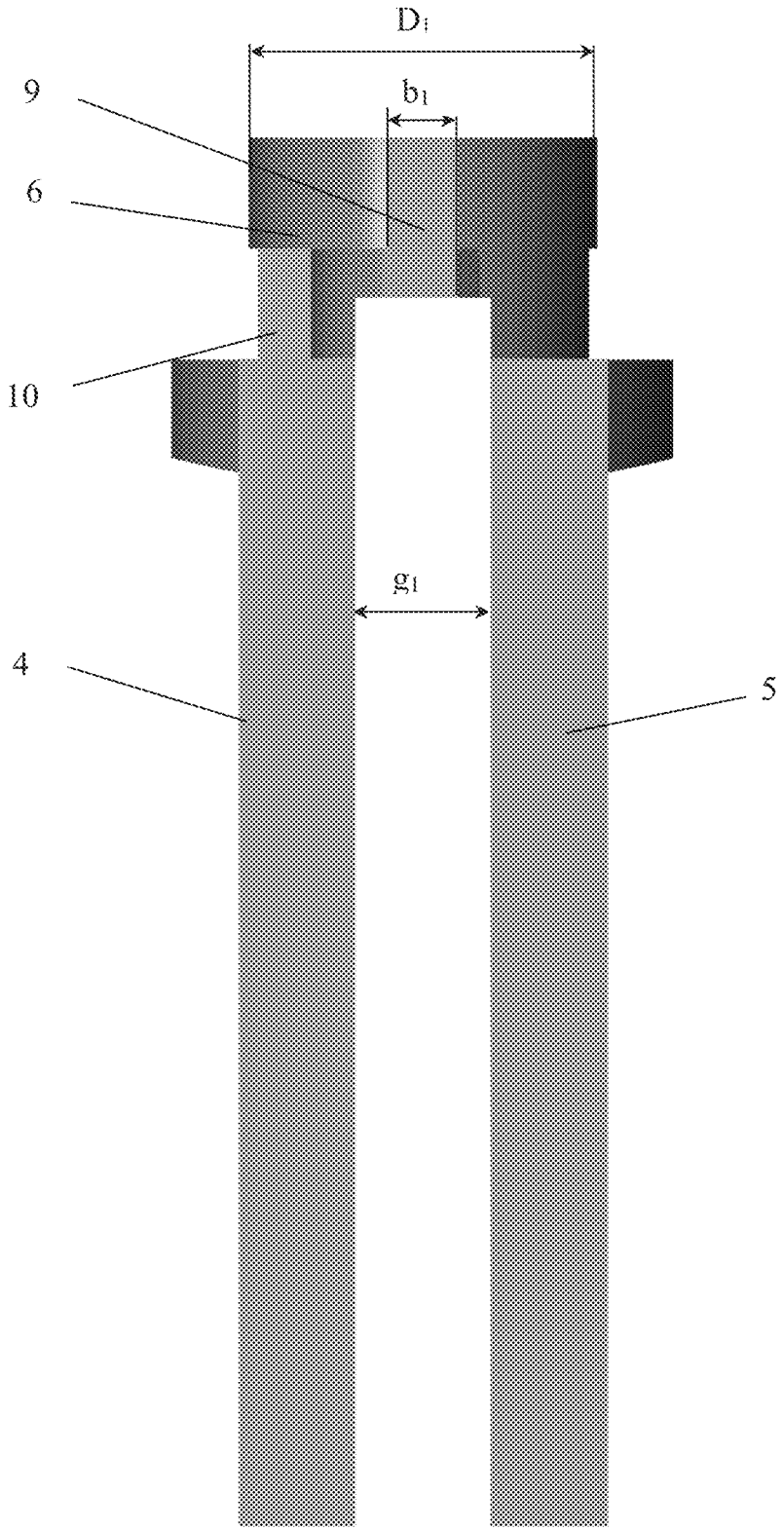
FIG. 2 is a cross section view of a setting.
Figure 3:
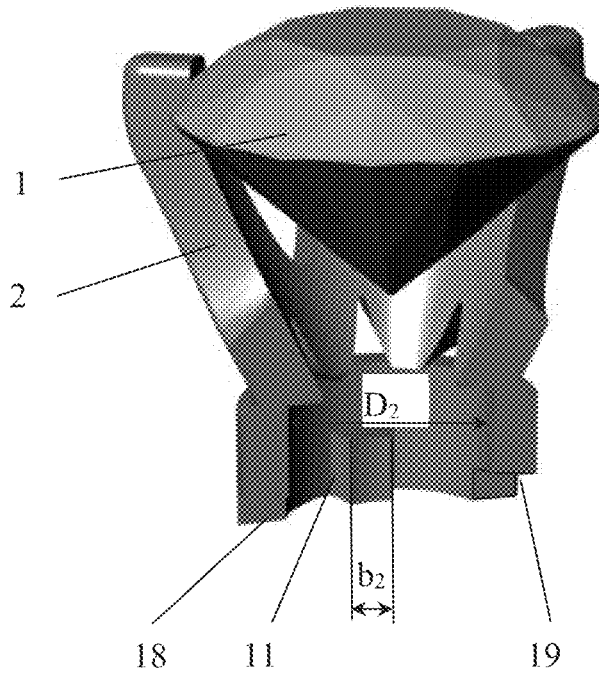
FIG. 3 is another cross-section view of a setting.
Figure 4:
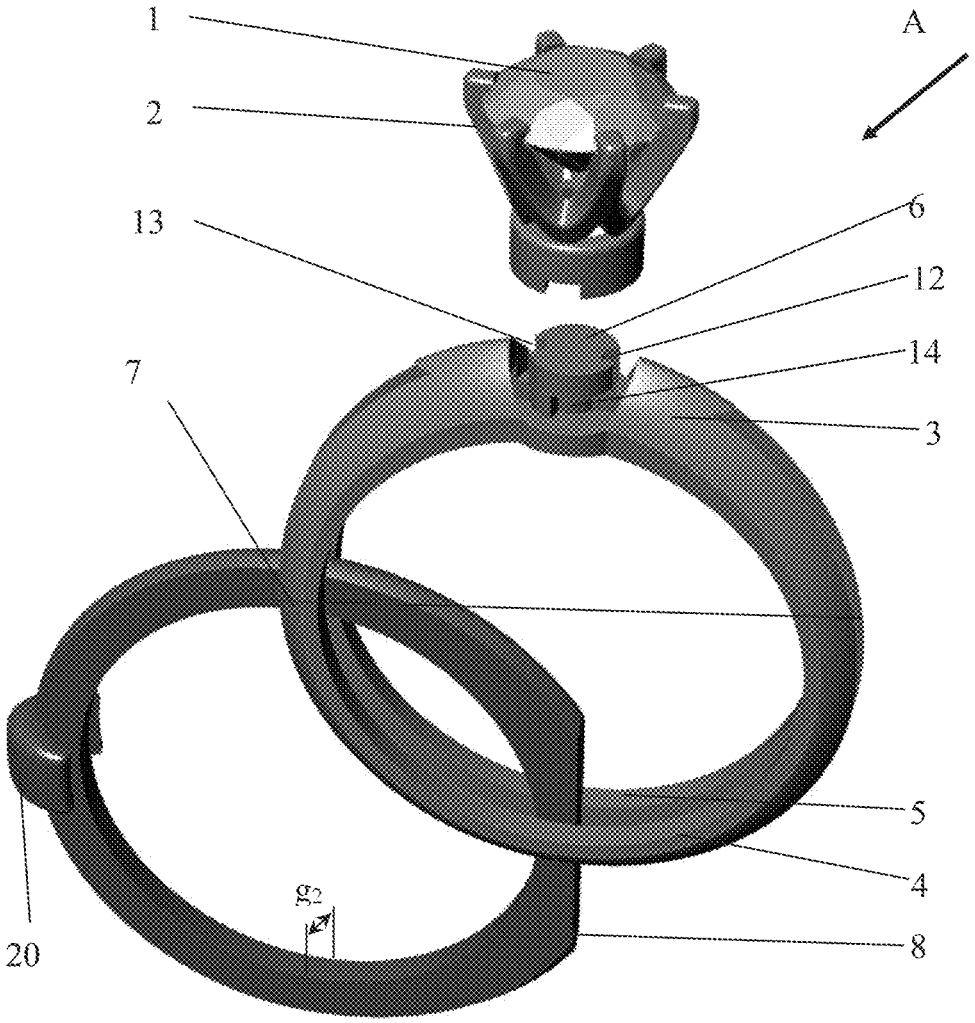
FIG. 4 is a cross section view of a annular jewelry part.
Figure 5:
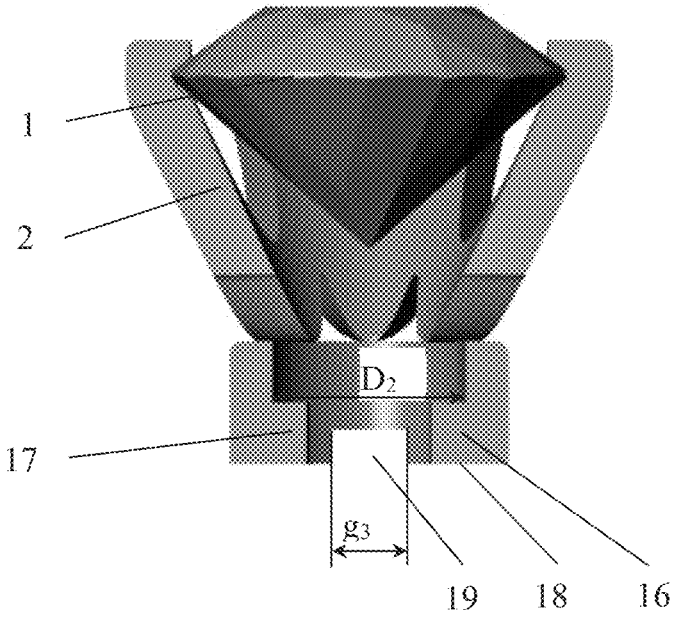
FIG. 5 is a perspective view of a jewelry.
Figure 6:
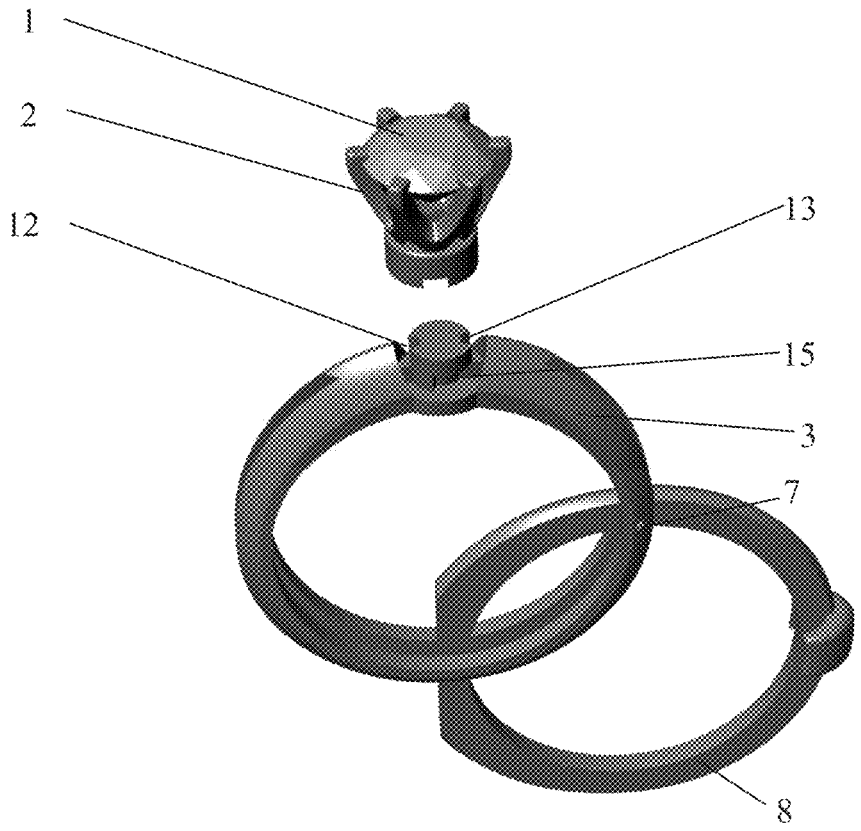
FIG. 6 shows variants of jewels installed in settings.

The utility model is illustrated by graphic images, wherein FIG. 1 shows a general view of the jewelry before changing the setting, and FIG. 2 is a cross-section of the setting. FIG. 3 shows a decorative jewel in the setting (section). FIG. 4 is a view of a variant of jewelry. FIG. 5 is a variant with the execution of a decorative jewel in a setting (section). FIG. 6 is a general view of jewelry, view "A" (from FIG. 4).

The piece of jewelry contains a decorative Jewel (FIG. 1) installed in a setting "2" and an annular Jewel "3" (FIG. 2). The piece of jewelry is completed with several interchangeable settings "2" with individual decorative jewels "1". Ring jewel "3", with a central hole, includes two main plates "4", "5" located at a distance from each other and connected between a cylindrical boss "6" with a diameter (FIG. 1). An additional plate "8" with a central hole and thickness is fixed on the main plates, through the fastener "7". The plate "8" is fixed with the possibility of rotation about the axis of part "7" and freely passes between the main plates "4" and plates "5".

On the surface of the boss "6," there is a fabricated longitudinal groove "9" and an annular "10" connected to it (FIG. 2).

The setting "2" is made hollow, with a cylindrical inner surface of diameter (FIG. 3). The ratio of diameters provides a clearance fit. On the inner, cylindrical surface of the setting "2", at least one protrusion is made with an outer dimension. The protrusion "11" due to the ratio of the dimensions, can move freely in the longitudinal groove "9" and the annular groove "10".

When two longitudinal grooves, for example, "12" and "13", are made, two annular grooves, "14" and "15", respectively connected to them, are made (FIG. 5). In this case, two protrusions "16" and "17" are made on the inner, cylindrical surface of setting 2" (FIG. 5). Wherein this simultaneous arrangement is ensured: the projection "16" in the longitudinal groove "12" and further annular "14", and the projection "17", respectively, in the longitudinal groove "13" and further annular "15".

In the end surface "18", setting "2", a recess "19" is made, with a width which is sufficient for the entry of a part of the additional plate "8" into it (FIG. 3).

In the working position, the additional plate "8" is rotated around the fastener "7" axis. The central holes of plates "4", "5," and "8" coincide. The plate "8" presses setting "2" through the surface "18" in the axial direction. When implementing the technical solution according to another embodiment, part of plate "8" enters recess "19".

The main plates "4" and plate "5" and additional plate "8" can be equipped with a lock of their relative position "20" (FIG. 1). The presence of the retainer "20" ensures that the position of the additional plate "8" remains unchanged relative to the main plates "4" and plate "5" in case of accidental loads on the jewelry when it is not positioned on the finger. For example, when a jewelry item falls from an elevation.

Decorative Jewel "1" only comes into contact with custom "2".

Figure 7:
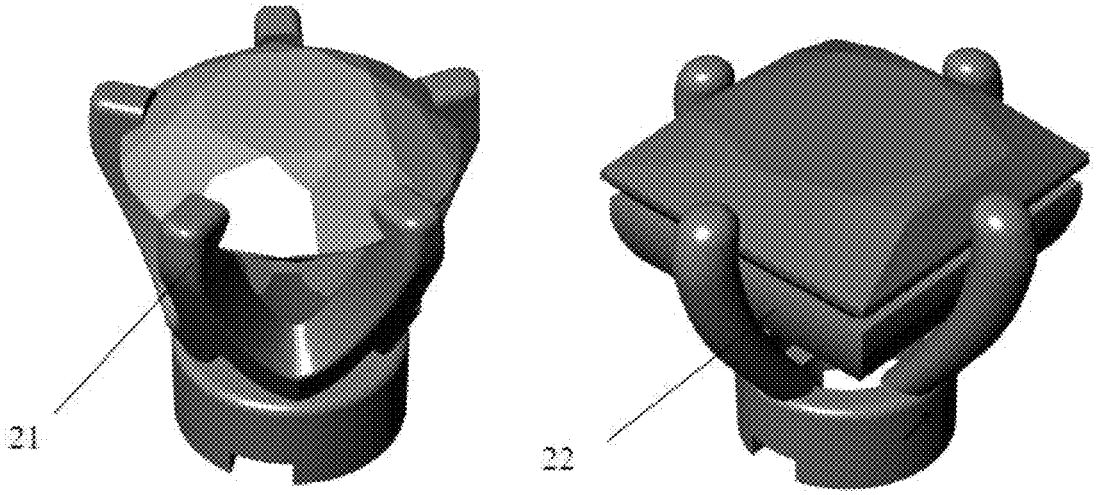
FIG. 7 is a perspective view of a jewelry.

The piece of jewelry is finished with several removable settings, "21" and "22" (FIG. 7), with individual decorative jewels installed in them. All settings: "2", "21," and "22", are made with identical cylindrical surfaces with a diameter "D1" and projections "11".

When performing the variant with two protrusions "16" and "17" during the assembly of the jewelry, they similarly move in the longitudinal grooves "12" and "13" and then in the annular grooves "14" and "15". The further assembly process is similar to that performed in the presence of one protrusion "11". The piece of jewelry operates as follows (FIG. 1). When implemented under the main claim of a utility model. decorative Jewel "1" is put into setting "2". The folding of the claws of setting "2" ensures adaptation to the actual size of decorative Jewel "1" and its reliable fixation in setting "2". The additional plate "8" is rotated around the axis of the fastener "7" so that its central hole and the central hole of the main plates "4" and plate "5" are separated (FIG. 1).

The setting "2" on a cylindrical surface with a diameter "D2", is installed on a cylindrical boss "6". The ratio of the diameters of the mating surfaces "D2>"D1" allows this to be done without difficulty. In this case, the projection "11" is located in the longitudinal groove "9". The setting "2" interchanges along the cylindrical boss "6" until projection "11" coincides with the annular groove 10. After that, the setting is rotated around the axis of the cylindrical boss "6". In this case, projection "11" moves along the annular groove "10". The walls of the annular groove "10" fix the projection "11" from movement along the axis of the boss "6". Fixation of the setting "2" from the exit from projection "11" is provided.

Then the additional plate "8" is rotated around the axis of fastener "7" until its central hole coincides with the central holes of plates "4" and plates "5". Plate "8" contacts the end surface "18". This additionally protects setting "2" from turning around the axis of protrusion "11" and disconnecting from it. The jewelry now becomes ready to use.

The working position of plate "8" relative to plate "4" and plate "5" is additionally provided by latch "20". This allows the user to maintain the working position of the jewelry in case of accidental impacts outside of use on the finger.

When implementing the technical solution under item "2", the assembly procedure fully complies with the previously defined. But when turning off the additional plate "8", its part enters recess "19". In this case, additional fixation of setting "2" from turning on the ledge "11" is carried out.

The simplicity of the procedure for replacing the decorative jewel "1" in conjunction with custom "2" allows the user to perform it directly while using the jewelry. The presence of interchangeable settings "21" and settings "22" allows them to be replaced within a short duration, even while using the jewelry.

Thus, the claimed jewelry can now provide a more reliable fixation of the constituent jewels, primarily the decorative jewel "1". When altering it in the jewelry, the need for additional fitting is eliminated, and its quick replacement allows you to expand the artistic and aesthetic significance of the jewelry.

In addition to rings, the jewelry according to the disclosure may be applied to earrings, bracelets, necklaces, and other jewelries with jewels installed thereon.

The invention claimed is:

1. An item of jewelry, comprising:

a ring-shaped component, wherein the ring-shaped component is provided with a centrally located opening and comprises a first main plate and a second main plate axially positioned at a predetermined distance from each other and coupled together by a cylindrical boss; and a third plate that is provided with a centrally located opening, wherein the third plate is attached to the first and second main plates through a fastener so that the third plate is rotatable around an axis of the fastener relative to the first and second main plates;

a position lock that keeps the third plate fixed relative to the ring-shaped component when the third plate rotates to a position where the centrally located opening of the third plate coincides with the centrally located opening of the ring-shape component; and a setting installed on the cylindrical boss and comprising a cylindrical inner surface from which at least one protrusion extends;

wherein the cylindrical boss comprises a longitudinal groove and an annular groove that intersect with each other, and the setting is installed to the cylindrical boss by the at least one protrusion reversibly engaged with the longitudinal groove and annular groove.

2. The item of jewelry according to claim 1, wherein the setting comprises a recess in an end surface of the setting that allows a part of the third plate to enter.

* * * * *